US011267111B2

(12) United States Patent
Irving

(10) Patent No.: US 11,267,111 B2
(45) Date of Patent: Mar. 8, 2022

(54) HOSE CLAMP SETTING TOOL AND SYSTEM

(71) Applicant: Honda Motor Co., Ltd., Tokyo (JP)

(72) Inventor: Connor Irving, Holland Landing (CA)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/983,702

(22) Filed: Aug. 3, 2020

(65) Prior Publication Data

US 2022/0032430 A1 Feb. 3, 2022

(51) Int. Cl.
*B25B 25/00* (2006.01)

(52) U.S. Cl.
CPC ..... *B25B 25/005* (2013.01)

(58) Field of Classification Search
CPC .. B25B 7/00; B25B 7/005; B25B 7/02; B25B 7/22; B25B 7/304; B25B 7/306; B25B 7/308
USPC ..... 81/418, 421, 422, 423, 424, 424.5, 426, 81/426.5; 29/243.56
See application file for complete search history.

(56) References Cited

U.S. PATENT DOCUMENTS

| | | | |
|---|---|---|---|
| 5,186,648 A | 2/1993 | Senra | |
| 5,209,143 A | 5/1993 | Sweet | |
| 5,590,573 A | 1/1997 | Detable | |
| 5,865,072 A | 2/1999 | Jerdee | |
| 8,302,283 B2 | 11/2012 | Bobenhausen | |
| 9,180,576 B2 * | 11/2015 | Wu | B25B 7/123 |
| 10,328,553 B1 * | 6/2019 | Pearson | B25B 23/142 |
| 2003/0167881 A1 | 9/2003 | Chauffeteau et al. | |
| 2008/0141831 A1 | 6/2008 | Ekola et al. | |
| 2009/0064823 A1 | 3/2009 | Huang | |
| 2010/0058895 A1 | 3/2010 | Wu | |
| 2018/0333832 A1 | 11/2018 | Liu | |

FOREIGN PATENT DOCUMENTS

| | | |
|---|---|---|
| DE | 4440210 | 5/1996 |
| FR | 2814974 | 4/2002 |
| GB | 2475046 | 5/2011 |
| JP | 5013457 | 8/2012 |

* cited by examiner

*Primary Examiner* — Lee D Wilson
*Assistant Examiner* — Alberto Saenz
(74) *Attorney, Agent, or Firm* — Rankin, Hill & Clark LLP

(57) ABSTRACT

A clamp setting tool secures a hose clamp having a pre-clamped state where a catch tab engages a stopper tab, and a clamped state where the catch tab releases from the stopper tab. The clamp setting tool includes first and second head elements having respective first and second notches formed therein, the second notch positionally corresponds to the first notch. The first and second notches receive the catch and stopper tabs. A stop mechanism is connected to one of the first and second head elements. The clamp setting tool moves the first and second head elements between an open position where the hose clamp is maintained in the pre-clamped state and a closed position where the first and second head elements move the hose clamp to the clamped state. The stop mechanism prevents movement of the first and second head elements from the open position toward the closed position.

19 Claims, 10 Drawing Sheets

HOSE CLAMP SETTING TOOL AND SYSTEM

BACKGROUND

Right angle needle nose pliers and pipe clamp pliers are known tools capable of setting a hose clamp for securing a hose on a hollow pipe. However, these common tools present difficulties when the hose clamp is required to be set a required position relative to surrounding parts (e.g., the hose clamp on an engine crankcase breather hose is required to be set at a predetermined angle relative to surrounding engine components for safety regulations), as the known tools have little or no control over the closing of the hose clamp. The use of the common tools also require additional time to set the hose clamp to the required position and due to space restrictions have the potential to cause damage to the surrounding parts.

BRIEF DESCRIPTION

According to one aspect, a clamp setting tool is adapted to secure an associated hose clamp. The associated hose clamp includes a pre-clamped state where an associated catch tab is engaged to an associated stopper tab, and a clamped state where the associated catch tab is released from the associated stopper tab. The clamp setting tool comprises a first head element and a second head element. The first head element includes at least one first notch formed therein and the second head element includes at least one second notch formed therein that positionally corresponds to the at least one first notch. The at least one first and second notches are configured to receive both the associated catch tab and the associated stopper tab of the associated hose clamp. A stop mechanism is connected to one of the first and second head elements. The clamp setting tool is configured to move the first and second head elements between an open position and a closed position. In the open position the first and second head elements are adapted to maintain the associated hose clamp in the pre-clamped state, and in the closed position the first and second head elements are adapted to move the associated hose clamp to the clamped state. The stop mechanism is configured to prevent movement of the first and second head elements from the open position toward the closed position.

According to one aspect, a clamp setting tool is adapted to secure an associated hose clamp. The associated hose clamp includes a pre-clamped state where an associated catch tab is engaged to an associated stopper tab, and a clamped state where the associated catch tab is released from the associated stopper tab. The clamp setting tool comprises a first member and a second member, the first member pivotally coupled to the second member forming pliers. A first head element is at a first end of the first member and a second head element is at a first end of the second member. Each of the first head element and the second head element is configured to receive both the associated catch tab and the associated stopper tab of the associated hose clamp. A first handle is at a second end of the first member and a second handle is at a second end of the second member. A stop mechanism is positioned between the first and second head elements. The stop mechanism includes a spring-biased sliding pin arrangement secured by one of the first and second head elements. The stop mechanism is configured to prevent movement of the first and second head elements from an open position where the associated hose clamp secured by the clamp setting tool is in the pre-clamped state toward a closed position where the associated hose clamp secured by the clamp setting tool is in the clamped state.

According to one aspect, a method of securing a flexible hose onto a hollow shaft via a hose clamp is provided. The hose clamp includes a pre-clamped state where a catch tab is engaged to a stopper tab, and a clamped state where the catch tab is released from the stopper tab. The method comprises (a) providing a clamp setting tool including: (i) a first head element and a second head element, the first head element includes at least one first notch formed therein and the second head element includes at least one second notch formed therein that positionally corresponds to the at least one first notch, and (ii) a stop mechanism connected to one of the first and second head elements, the stop mechanism configured to prevent movement of the first and second head elements from an open position toward a closed position.

The method further comprises (b) placing the hose clamp in the pre-clamped state loosely over an end portion of the hose mounted on the hollow shaft; (c) moving the first and second head elements to the open position and engaging the hose clamp with the clamp setting tool by positioning the catch tab and the stopper tab of the hose clamp within the first and second notches; (d) with the hose clamp in the pre-clamped state engaged by the clamp setting tool, rotating the clamp setting tool toward an associated component adjacent the hose end portion; (e) exerting a force on the stop mechanism via contact of the stop mechanism with the associated component to move the stop mechanism from a normally locked state to an unlocked state; and (f) with the stop mechanism in the unlocked state moving the first and second head elements toward the closed position to release the catch tab from the stopper tab, thereby moving the hose clamp to the clamped state.

DETAILED DESCRIPTION

Figure 1:
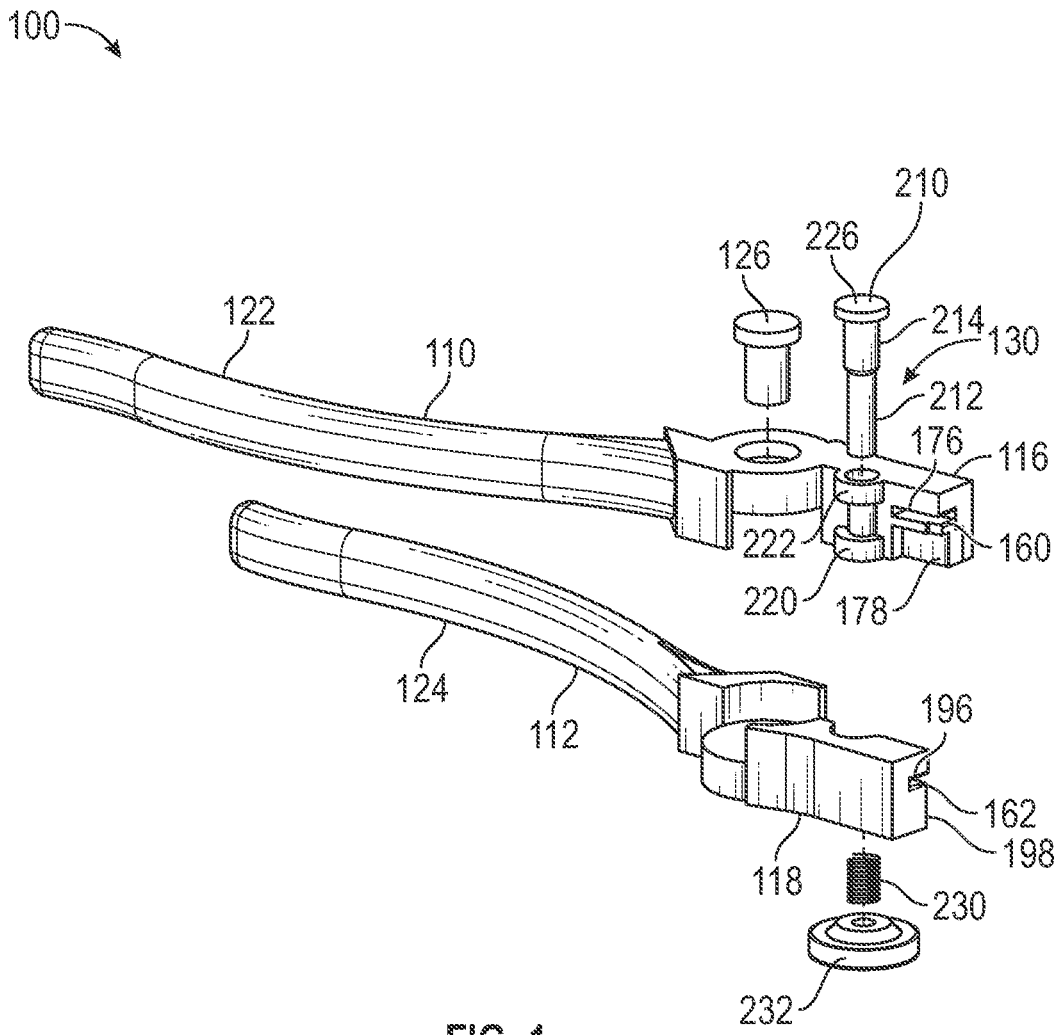
FIG. 1 is an exploded perspective view of a clamp setting tool according to the present disclosure.
Figure 2:
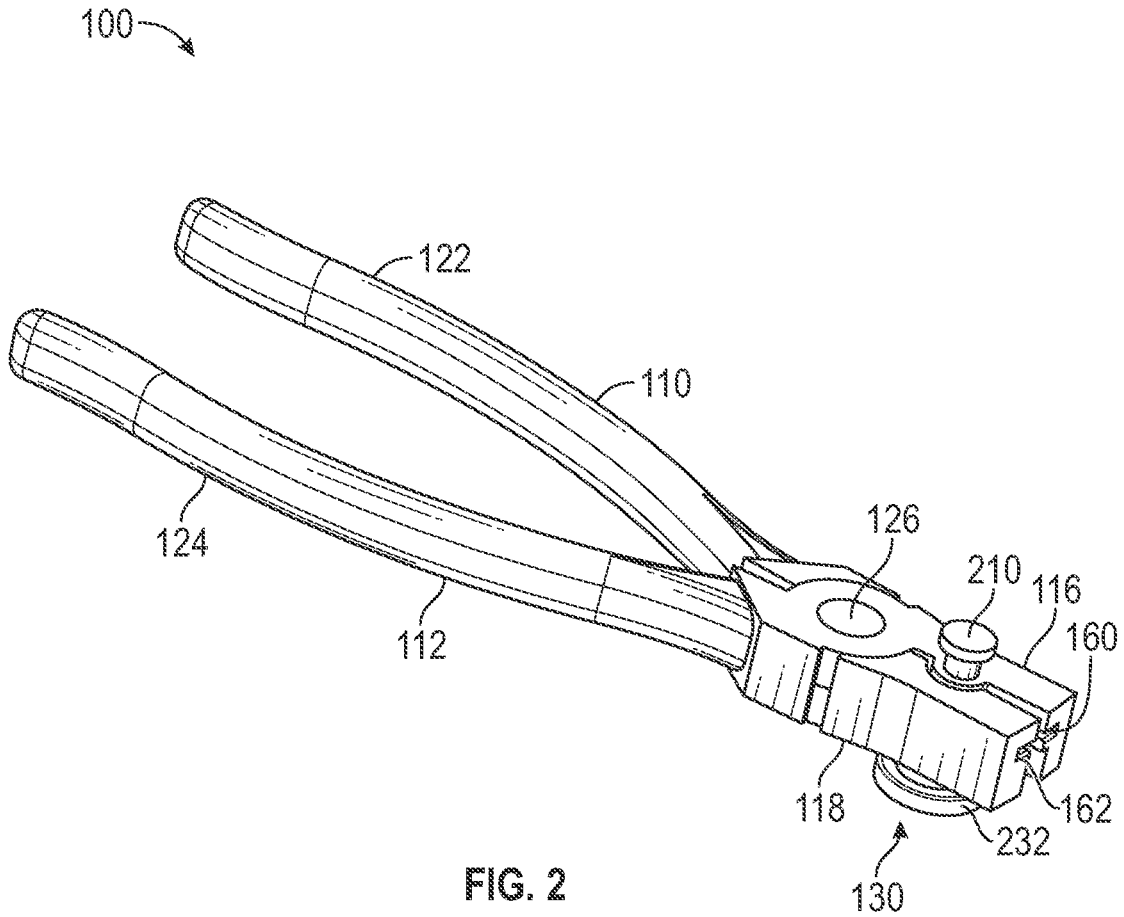
FIG. 2 is a perspective view of the clamp setting tool.

It should, of course, be understood that the description and drawings herein are merely illustrative and that various modifications and changes can be made in the structures disclosed without departing from the present disclosure. Referring now to the drawings, wherein like numerals refer to like parts throughout the several views, FIGS. 1-7 illustrate a clamp setting tool 100 adapted to secure a hose clamp 102 (FIGS. 8-11) according to the present disclosure. The exemplary clamp setting tool 100 generally comprises a first member 110 and a second member 112. A first head element 116 is provided at a first end of the first member 110, and a second head element 118 is provided at a first end of the second member 112. As will be described in detail below, each of the first head element 116 and the second head element 118 is configured to engage the hose clamp 102 and reposition the hose clamp from a pre-clamped state to a clamped state. A first handle 122 is at a second end of the first member 110 and a second handle 124 is at a second end of the second member 112. A gripping sleeve can be sleeved onto each of the first and second handles. The first member 110 is pivotally coupled to the second member 112 via a hinge joint (e.g., pivot pin 126), thereby forming pliers. Accordingly, in this embodiment, the first head element 116 and the second head element 118 are moved between an open position (FIGS. 5 and 6) and a closed position (FIG. 7) by the first and second handles 122, 124; although, alternative configurations for moving the first and second head elements (e.g., ratcheting devices) are contemplated. A stop mechanism 130 is positioned between the first and second head elements 116, 118. The stop mechanism has a normally locked state and an unlocked state and is configured to prevent movement of the clamp setting tool 100 (i.e., the first and second head elements 116, 118) from the open position toward the closed position.

Figure 8:
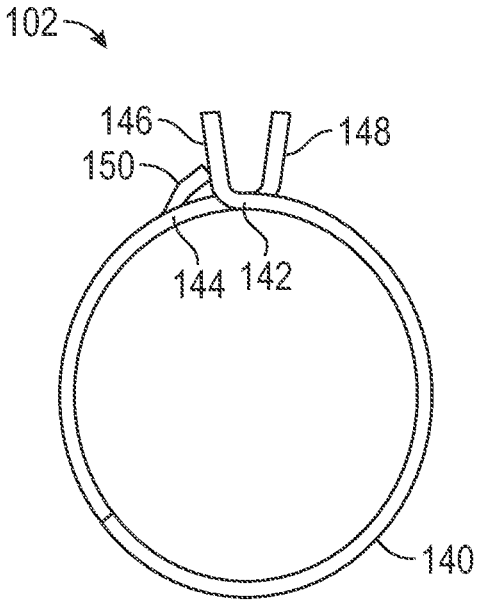
FIG. 8 is a side view of one example of a hose clamp for use with the clamp setting tool, the hose clamp in a pre-clamped state.
Figure 9:
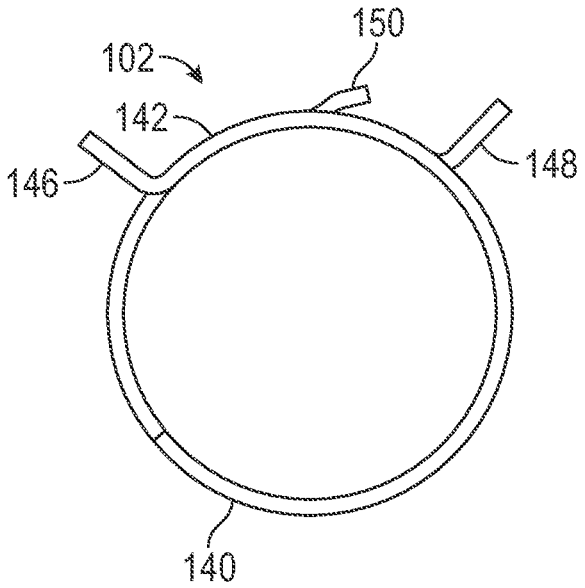
FIG. 9 is a side view of the hose clamp in a clamped state.
Figure 10:
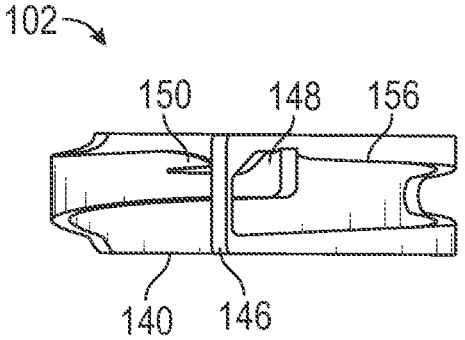
FIG. 10 is a top view pf FIG. 8.
Figure 11:
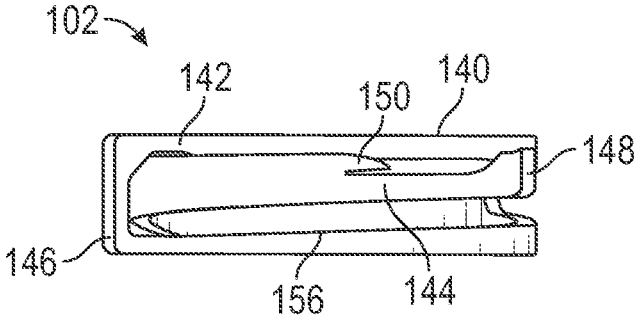
FIG. 11 is a top view of FIG. 9.

One example of the hose clamp 102 for use with the clamp setting tool 100 is shown in FIGS. 8-11. The hose clamp 102 includes a plate spring body 140 which is in annular form having opposite ends 142, 144. The end 142 defines a stopper tab 146 and the end 144 defines a catch tab 148 with a barb 150. The body 140 is provided with an elongated grooved notch 156 that extends partially through the stopper tab 146 such that the stopper tab has an inverted U-shape. The end 144 is inserted through and retained within the notch 156. When the hose clamp 102 is manufactured it is set into the pre-clamped state with the catch tab 148 pressed to one side of the body 140 to allow the barb 150 to engage the stopper tab 146. This engagement allows the hose clamp 102 to remain sprung open in its pre-clamped state (FIGS. 8 and 10). To move the hose clamp to the clamped state, a force is applied to the catch tab 148 to displace the tab in a lateral direction toward an opposite side of the body 140. As the catch tab 148 is moved, the barb 150 is released from the stopper tab 146, allowing the catch tab 148 together with the barb 150 to move along the notch 156 thereby placing the hose clamp 102 in the clamped state (FIGS. 9 and 11).

Figure 3:
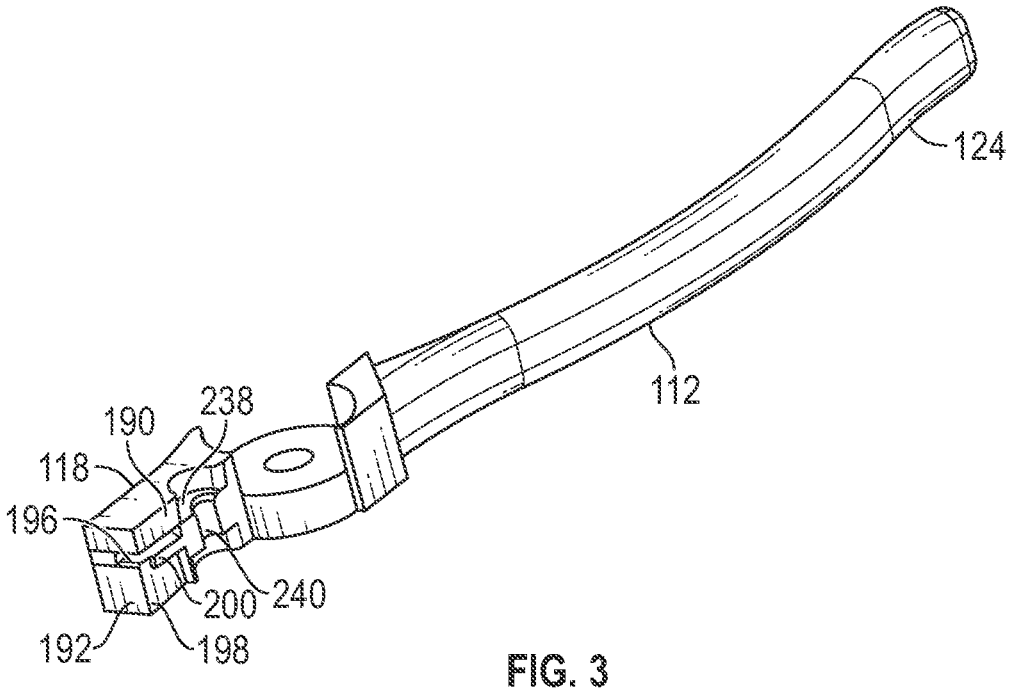
FIGS. 3 and 4 are perspective views of handle members of the clamp setting tool.
Figure 4:
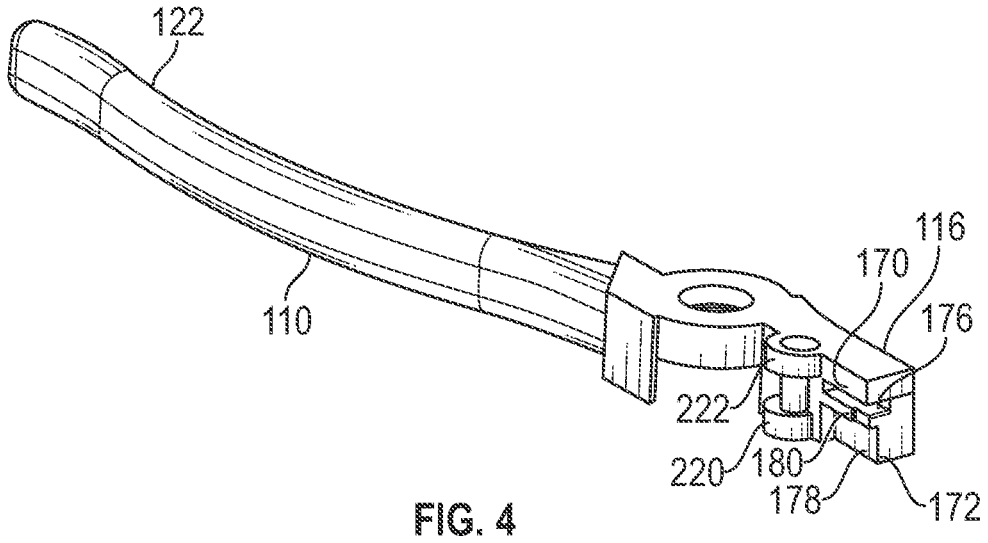

With reference to FIGS. 3 and 4, each of the first head element 116 and the second head element 118 is configured to receive both the stopper tab 146 and the catch tab 148 of the hose clamp 102. In the depicted aspect, the first head element 116 includes at least one first notch 160 formed therein and the second head element 118 includes at least one second notch 162 formed therein that positionally corresponds to the at least one first notch 160. The at least one first and second notches 160, 162 are configured to receive both the stopper tab 146 and the catch tab 148. More particularly, the first head element 116 includes a first engaging face 170 and a first end face 172. The at least one first notch 160 of the first head element 116 includes a first upper notch 176 and a first lower notch 178, each formed in both the first engaging face and the first end face. The first upper and lower notches 176, 178 are spaced from one another so that a section 180 of the first engaging face 170 is located therebetween. Similarly, the second head element 118 includes a second engaging face 190 and a second end face 192. The at least one second notch 162 of the second head element 118 includes a second upper notch 196 aligned with the first upper notch 176 and a second lower notch 198 aligned with the first lower notch 178, each formed in both the second engaging face and the second end face. The second upper and lower notches 196, 198 are spaced from one another so that a section 200 of the second engaging face 190 is located therebetween.

The first and second upper notches 176, 196 are collectively sized for sliding receipt of the stopper tab 146 of the hose clamp 102. The first and second lower notches 178, 198 are collectively sized for sliding receipt of the catch tab 148 of the hose clamp 102. Further, when viewing the first and second end faces 172, 192, because the catch tab 148 is shifted laterally relative to the stopper tab 146 in the pre-clamped state of the hose clamp 102, a depth of the first lower notch 178 is greater than a depth of the second lower notch 198. This also allows for a first displacement of the catch tab 148 relative to the stopper tab 146 along a first direction (i.e., a lateral direction of the spring body 140 of the hose clamp 102) as the hose clamp is being moved to the clamped state by the first and second head elements 116, 118.

Figure 6:
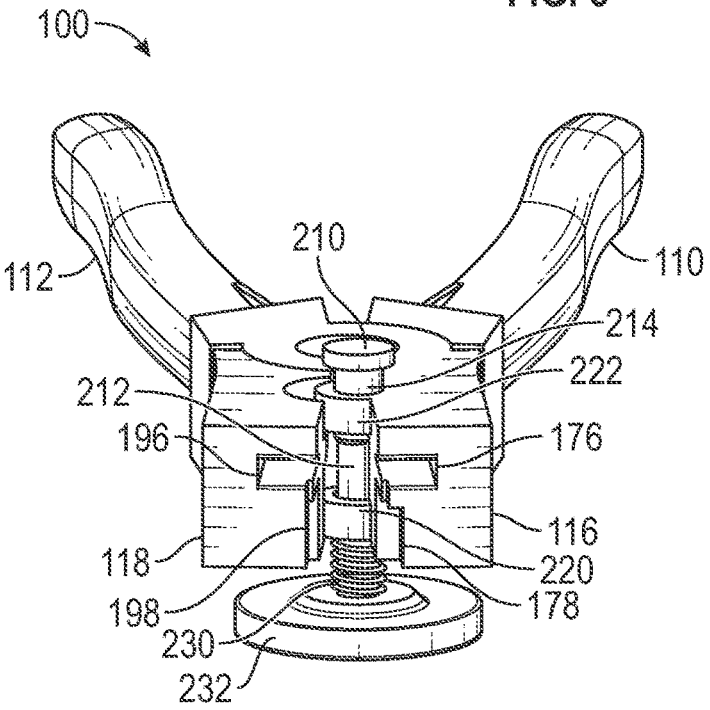
FIG. 6 is a perspective view of the clamp setting tool in a partially or intermediate open position.
Figure 7:
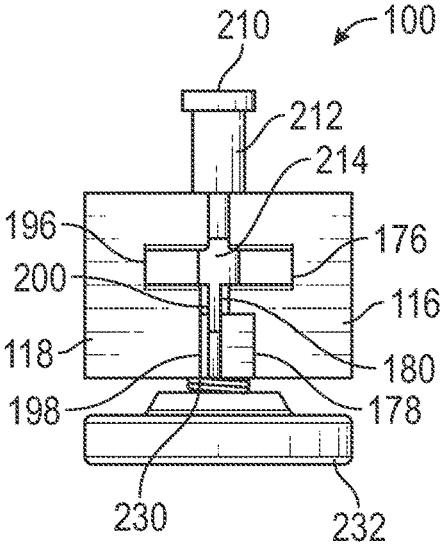
FIG. 7 is a perspective view of the clamp setting tool in a closed position.

The stop mechanism 130 is connected to one of the first and second head elements 116, 118, and in the depicted aspect the first head element is configured to retain the stop mechanism between the first and second head elements. As indicated previously, the stop mechanism 130 is configured to prevent movement of the first and second head elements from the open position (FIGS. 5 and 6) toward the closed position (FIG. 7). To this end, the stop mechanism includes a sliding pin arrangement with a lock pin 210 movable between the locked state where the clamp setting tool 100 is in the open position and the unlocked state where the clamp setting tool 100 is in the closed position. As best depicted in FIG. 1, the lock pin 210 is configured to include a first section 212 having a first diameter and a second section 214 having a second diameter greater than the first diameter. The lock pin 210 is received in hinge parts formed on the first head element 116, with a lower hinge part 220 sized to receive the first section 212 and an upper hinge part 222 sized to receive the second section 214. One end (the second section end) of the lock pin 210 includes a cap 226 to limit axial displacement of the lock pin into the first head element 116. An opposite end (the first section end) of the lock pin 210 receives a spring 230 and is mounted to a plate 232. In assembly, the lock pin 210 in inserted through the hinge parts 220, 222 with the spring retained between the lower hinge part 220 and the plate 232.

Figure 5:
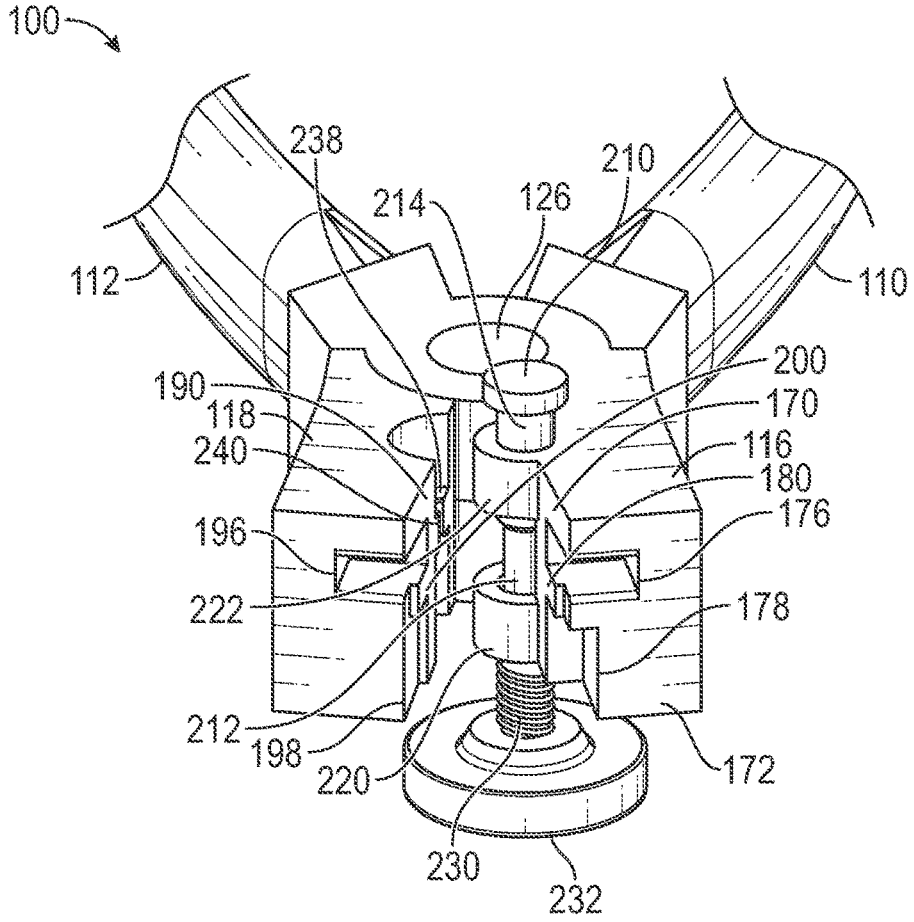
FIG. 5 is a perspective view of the clamp setting tool in an open position.

In FIG. 3, the second head element 118 includes a mounting section 238 formed as part of the stop mechanism 130 which is sized to fit between the hinge parts 220, 222 in the closed position of the clamp setting tool 100. The mounting section 238 includes a groove cutout 240 shaped to only receive therein the first section 212 of the lock pin 210 (i.e., the groove cutout 240 has the same diameter as the smaller first section 212 of the lock pin), in turn preventing the clamp setting tool 100 from moving to the closed position with the second section 214 of the lock pin 210 at least partially located between the hinge parts 220, 222. With the arrangement of the stop mechanism 130 described above, the lock pin 210 is biased toward the locked state, where the second section 214 is received in the upper hinge part 222 and partially between the hinge parts 220, 222. This positioning of the second section 214 between the first and second head elements 116, 118 prevents the mounting section 238 from receiving the lock pin 210, thereby maintaining the clamp setting tool 100 in the open position (FIGS. 5 and 6). A force exerted or directed on the plate 232 compresses the spring 230 and moves the lock pin 210 such that the second section 214 is no longer between the hinge parts 220, 222. With the displacement of the lock pin 210, the cutout 240 of the mounting section 238 receives the first section 212 of the lock pin and the clamp setting tool 100 is able to move to the closed position (FIG. 7). Therefore, the clamp setting tool 100 is configured to move the first and second head elements 116, 118 between the open and closed positions, where in the open position the first and second head elements are adapted to maintain the hose clamp 102 in the pre-clamped state, and in the closed position the first and second head elements 116, 118 are adapted to move the hose clamp 102 to the clamped state by causing the catch tab 148 to release from the stopper tab 146.

Accordingly, the exemplary clamp setting tool 100 includes the first and second handles 122, 124 and the first and second head elements 116, 118 interconnected by a hinge joint 126. The first and second head elements 116, 118 include the pair of upper notches 176, 196 that align with each other when the first and second head elements are brought together. The upper notches 176, 196 are collectively sized for sliding receipt of the stopper tab 146 of the hose clamp 102. The catch tab 148 of the hose clamp 102 is received in a lower notch, which is defined by one of the first and second head elements (e.g., first lower notch 178). As shown, the first lower notch 178 is sized to extend into the first end face 172 of the first head element 116. This allows for ejection of the catch tab 148 from the clamp setting tool 100 when the two tabs 146, 148 are finally shifted laterally (i.e., a first displacement along a first direction) by the full closure of the clamp setting tool 100. To this end, the first and second engaging faces 170, 190 confront each other in the closed position of the first and second head elements 116, 118. The sections 180, 200 of the engaging faces 170, 190 define a passageway sized to guide a second displacement of the catch tab 148 relative to the stopper tab 146 along a second direction as the hose clamp 102 is moved to the clamped state. The exemplary clamp setting tool 100 also includes the spring-biased sliding pin arrangement that prevents full closure of the clamp setting tool (which actuates the release of the two tabs 146, 148 from each other) unless the lock pin 210 is shifted upwardly by contact with an adjacent component. As shown, the lock pin includes relatively small and large diameter sections 212, 214 that respectively disable and enable full closure of the clamp setting tool 100.

Figure 12:
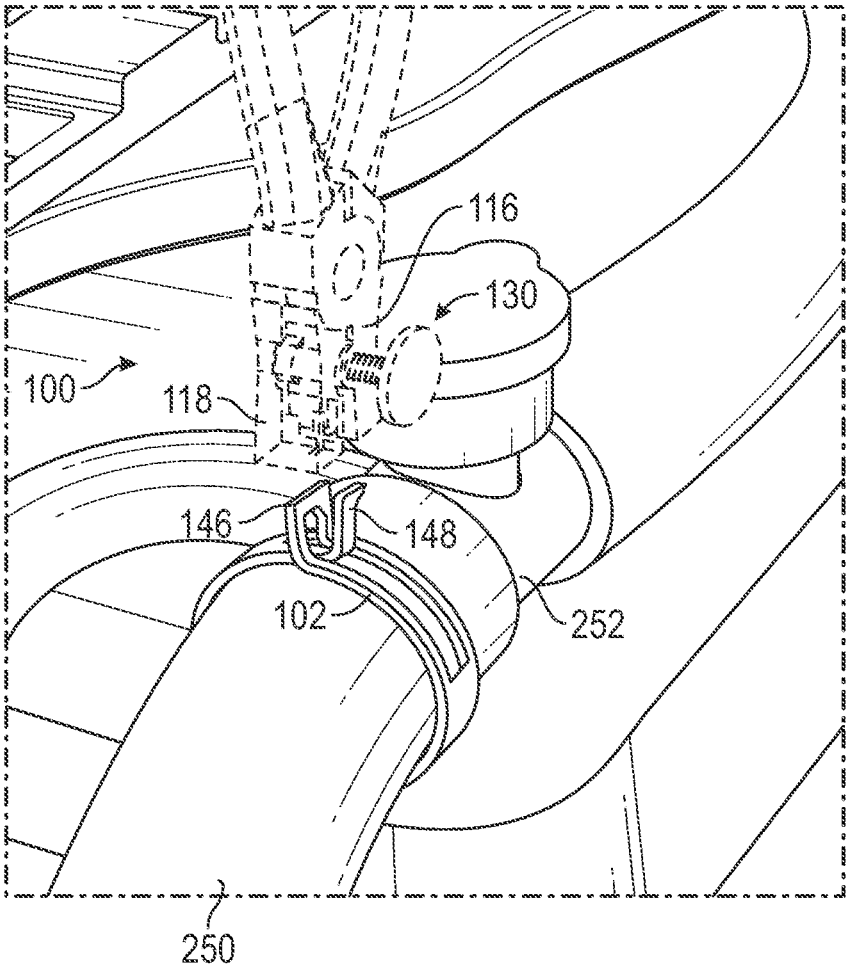
FIGS. 12, 13, 14, 15 and 16 depict an exemplary method of securing a hose onto a hollow shaft via the hose clamp with use of the clamp setting tool.
Figure 13:
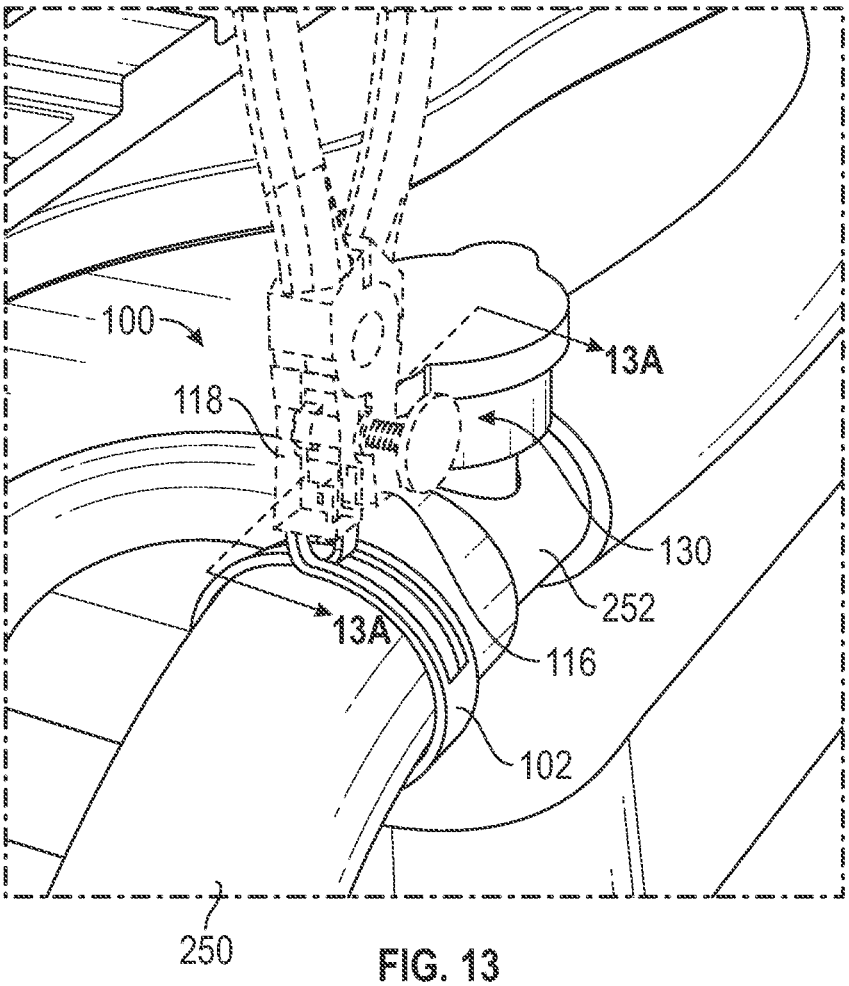
Figure 13A:
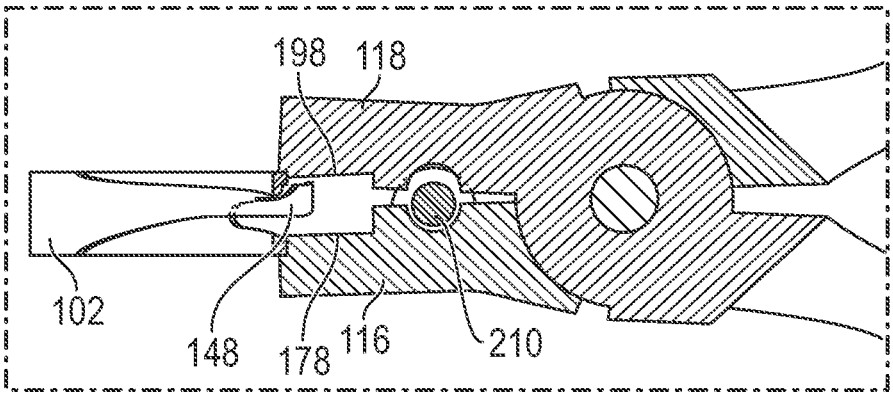
FIG. 13A is a cross-section view of FIG. 13 taken generally along line 13A-13A of FIG. 13.

FIGS. 12-16 depict an exemplary method of securing a hose 250 (e.g., a breather hose) onto a hollow shaft 252 via the hose clamp 102 with use of the clamp setting tool 100. The hose clamp 102 is initially placed onto the hose 250 in the pre-clamped state where the catch tab 148 is engaged to the stopper tab 146 (FIG. 12). In FIG. 13, the tabs 146, 148 are engaged by the clamp setting tool 100 in its open position to orient the hose clamp 102 in the pre-clamped state in a desired rotational position and release the tabs 146, 148 to set the hose clamp (the hose clamp 102 is in the clamped state in FIG. 16). The stopper tab 146 is received in the aligned first and second upper notches 176, 196 of the first and second head elements 116, 118, and the catch tab 148 is received in at least the first lower notch 178 of the first head element 116 (FIG. 13A). The stop mechanism in FIG. 13A in in its locked state.

Figure 14:
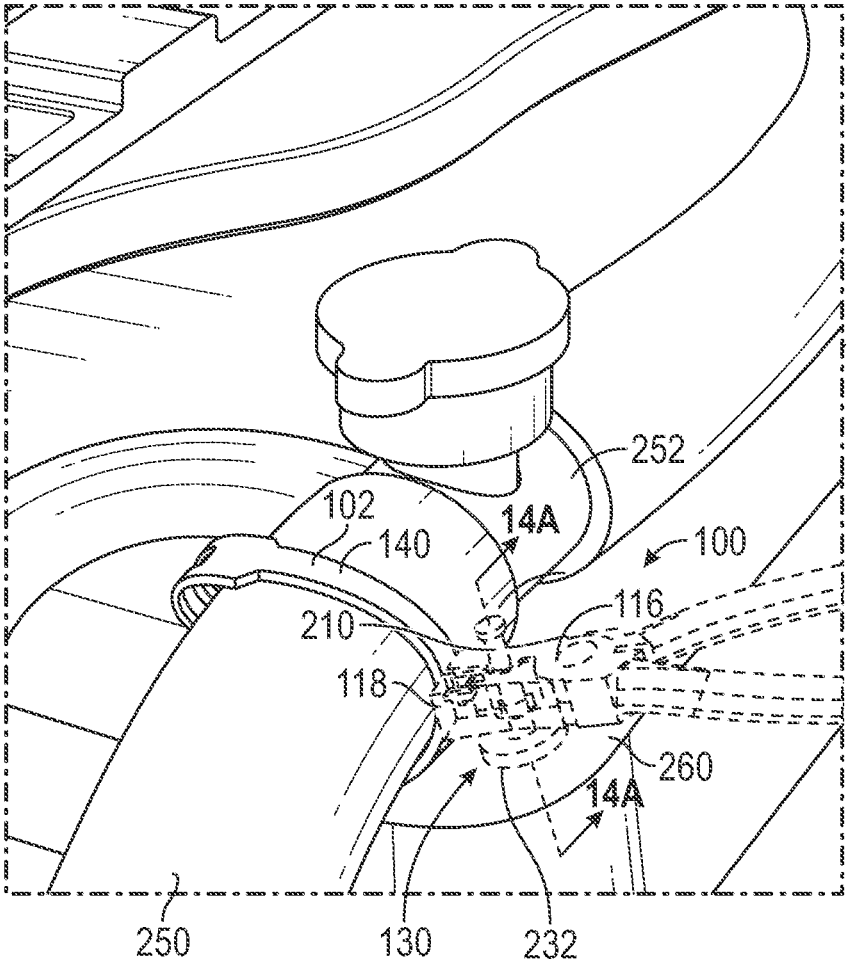
Figure 14A:
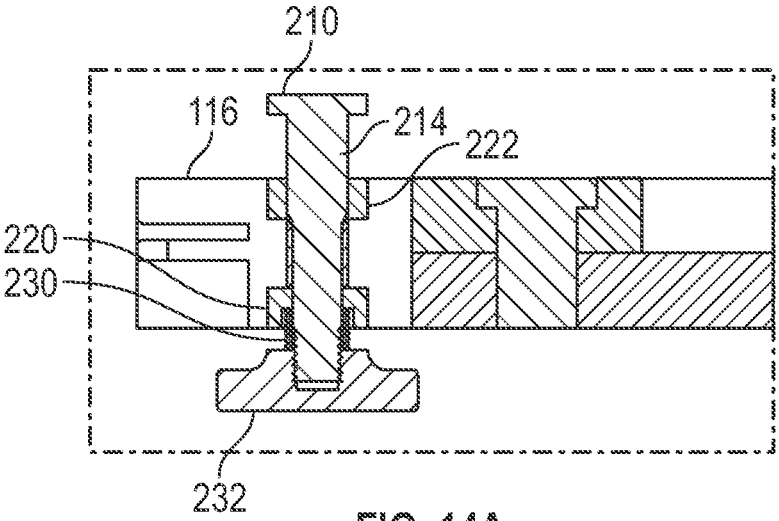
FIG. 14A is a cross-section view of FIG. 14 taken generally along line 14A-14A of FIG. 14.

In FIG. 14, the clamp setting tool 100 with the hose clamp 102 in the pre-clamped state is rotated with respect to the hose 250 until the plate 232 of the stop mechanism 130 contacts an adjacent engine component 260. The hose clamp 102 is now positioned in the desired angular location on the underlying hose 205. As can be seen, however, the coiled spring body 140 of the hose clamp is still maintained in the expanded-coil condition with the clamp setting tool 100 held in a partially open position. In FIG. 14A, however, the lock pin 210 has been shifted upwardly by the contact with an adjacent engine component 260, and because the second section 214 is no longer between the hinge parts 220, 222 the clamp setting tool 100 can move to the closed position.

Figure 15:
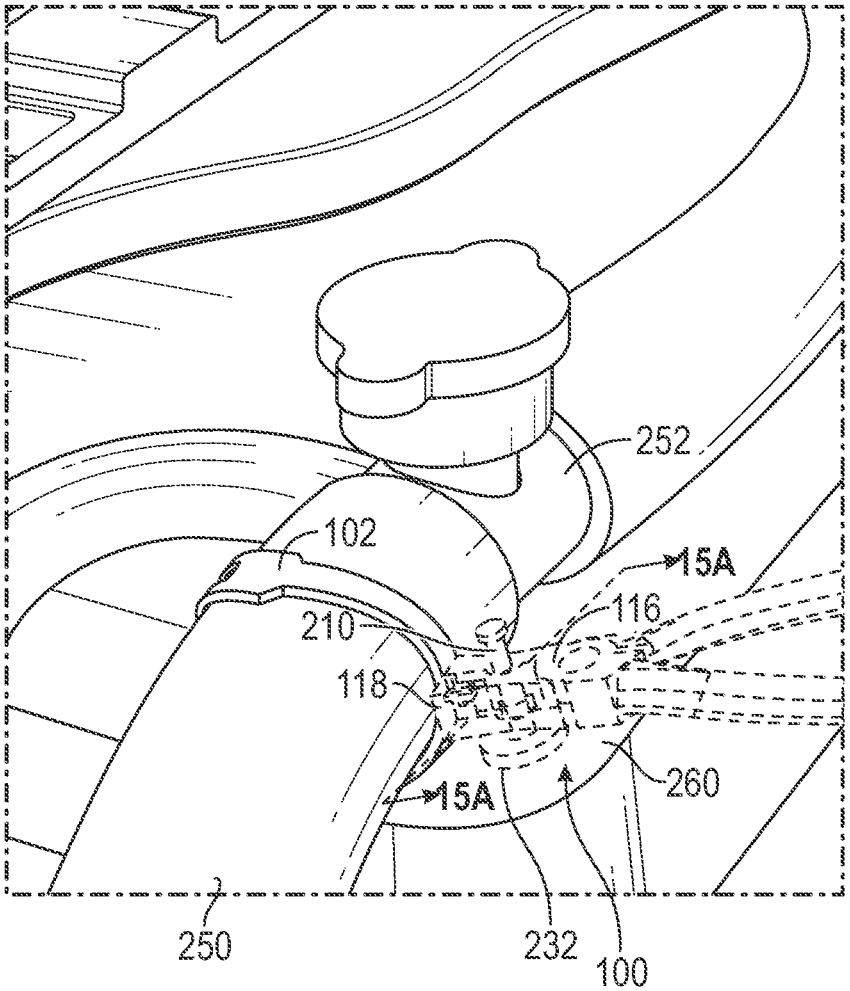
Figure 15A:
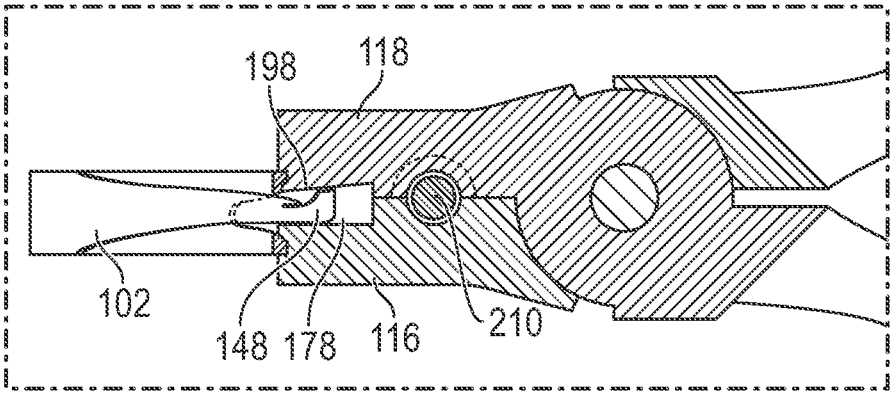
FIG. 15A is a cross-section view of FIG. 15 taken generally along line 15A-15A of FIG. 15.
Figure 16:
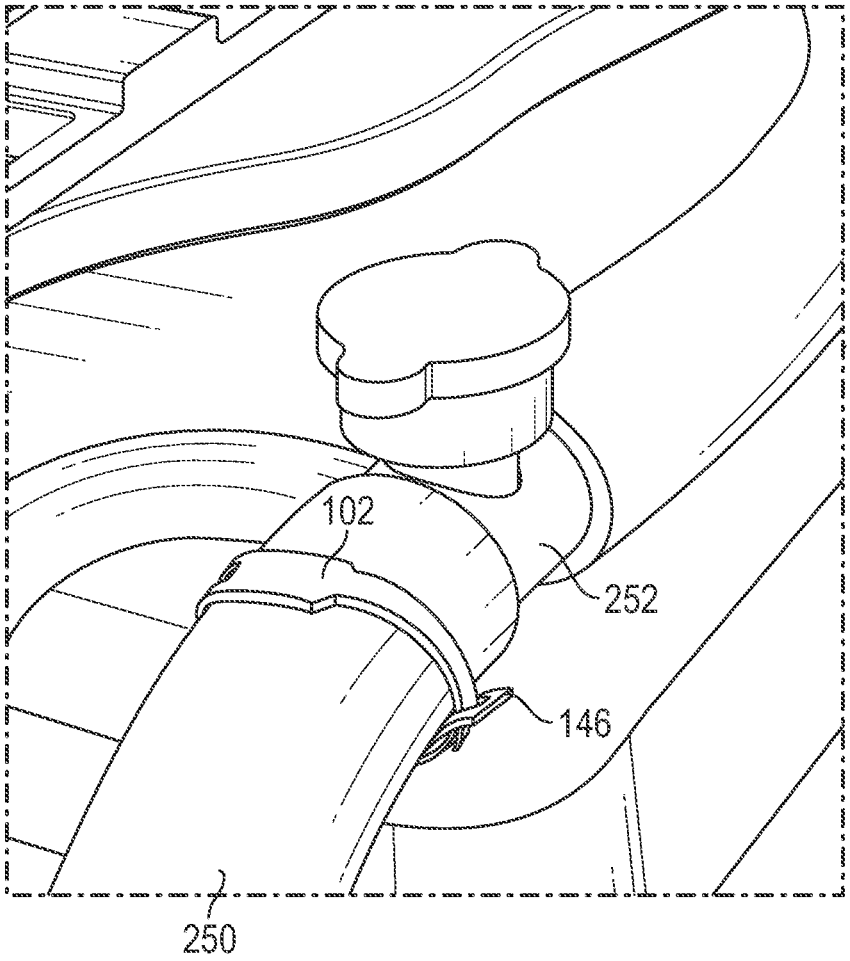

FIG. 15 depicts the clamp setting tool 100 in the closed position. This movement toward the closed position (and the associated movement in the first and second lower notch 178, 198) laterally shifts the catch tab 148 relative to the stopper tab 146 (which is held stationary by the clamp setting tool 100), thereby unlocking the tabs from each other (FIG. 15A). Once released, the catch tab 148 is ejected from the clamp setting tool along the pathway defined by the first and second engaging faces 170, 190 of the first and second head elements 116, 118 and via the open end of the first lower notch 178. The ejection of the catch tab 148 moves the hose clamp 102 to the clamped state on the hose 250. The clamp setting tool 100 is then removed (from the stopper tab 146) leaving the hose clamp 102 on the hose 250 in the desired set position (FIG. 16). Therefore, the clamp setting tool 100 prevents the user from setting the hose clamp 102 until it is in the proper location relative to surrounding components and controls the closing of the hose clamp 102.

Accordingly, a method of securing a flexible hose 250 onto a hollow shaft 252 via a hose clamp 102 is provided. The method comprises (a) providing a clamp setting tool 100 as described above; (b) placing the hose clamp 102 in the pre-clamped state loosely over an end portion of the hose 250 mounted on the hollow shaft 252; (c) moving the first and second head elements 116, 118 to the open position and engaging the hose clamp 102 with the clamp setting tool 100 by positioning the stopper tab 146 and the catch tab 148 of the hose clamp within the first and second notches 160, 162; (d) with the hose clamp 102 in the pre-clamped state engaged by the clamp setting tool 100, rotating the clamp setting tool 100 toward an associated component 260 adjacent the hose end portion; (e) exerting a force on the stop mechanism 130 via contact of the stop mechanism 130 with the associated component 260 to move the stop mechanism 130 from a normally locked state to an unlocked state; and (f) with the stop mechanism 130 in the unlocked state moving the first and second head elements 116, 118 toward the closed position to release the catch tab 148 from the stopper tab 146, thereby moving the hose clamp 102 to the clamped state.

The exemplary method further includes positioning the stopper tab 146 within the first and second upper notches 176, 196 of the first and second head elements 116, 118, positioning the catch tab 148 in at least the first lower notch 178 of the first head element, and moving the catch tab 148 within the first lower notch 178 to release the catch tab 148 from the stopper tab 146.

It will be appreciated that the above-disclosed features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A clamp setting tool capable of securing an associated hose clamp having an associated catch tab and an associated stopper tab, the associated hose clamp includes a pre-clamped state where the associated catch tab is engaged to the associated stopper tab, and a clamped state where the associated catch tab is released from the associated stopper tab, the clamp setting tool comprising:

a first head element and a second head element, the first head element includes at least one first notch formed therein and the second head element includes at least one second notch formed therein that positionally corresponds to the at least one first notch; and a stop mechanism connected to one of the first and second head elements, wherein the clamp setting tool is configured to move the first and second head elements between an open position and a closed position, where in the open position the first and second head elements are adapted to maintain the associated hose clamp in the pre-clamped state, and in the closed position the first and second head elements are adapted to move the associated hose clamp to the clamped state, wherein the stop mechanism is configured to prevent movement of the first and second head elements from the open position toward the closed position, wherein the first head element includes a first engaging face and a first end face intersecting the first engaging face, and the second head element includes a second engaging face and a second end face intersecting the second engaging face, the first and second engaging faces confronting each other in the closed position of the first and second head elements, wherein the at least one first notch is formed in both the first engaging face and the first end face, the at least first notch configured to simultaneously receive both the associated catch tab and the associated stopper tab of the associated hose clamp in the open position and in the closed position of the first and second head elements, wherein the at least one second notch is formed in both the second engaging face and the second end face, the at least one second notch is configured to receive the associated stopper tab together with the at least one first notch in the open position and in the closed position of the first and second head elements.

2. The clamp setting tool of claim 1, wherein the at least one first notch includes a first upper notch and a first lower notch, and the at least second notch is a second upper notch aligned with the first upper notch.

3. The clamp setting tool of claim 2, wherein the first and second upper notches are collectively sized for sliding receipt of the associated stopper tab of the associated hose clamp in the open position and in the closed position of the first and second head elements.

4. The clamp setting tool of claim 3, wherein the first lower notch is sized to receive the associated catch tab of the associated hose clamp and allow for a first displacement of the associated catch tab relative to the associated stopper tab along a first direction as the associated hose clamp is moved to the clamped state.

5. The clamp setting tool of claim 4, wherein the first upper notch and the first lower notch are formed in both the first engaging face and the first end face, the first upper and lower notches are spaced from one another so that a section of the first engaging face is located therebetween, and wherein the second upper notch is formed in both the second engaging face and the second end face.

6. The clamp setting tool of claim 1, wherein the first and second head elements define a passageway sized to guide a second displacement of the associated catch tab relative to the associated stopper tab along a second direction as the associated hose clamp is moved to the clamped state.

7. The clamp setting tool of claim 6, wherein the passageway is defined by the first and second engaging faces.

8. The clamp setting tool of claim 1, wherein stop mechanism is positioned between the first and second head elements and includes a sliding pin arrangement secured by one of the first and second head elements.

9. The clamp setting tool of claim 8, wherein the sliding pin arrangement includes a lock pin movable between a locked state and an unlocked state, and the lock pin is biased toward the locked state.

10. The clamp setting tool of claim 9, wherein the lock pin is configured to include a first section having a first diameter and a second section having a second diameter greater than the first diameter, where in the locked state the second section is positioned between the first and second head elements.

11. The clamp setting tool of claim 9, wherein at least one of the first and second head elements is configured to secure the lock pin in both the locked state and the unlocked state.

12. A clamp setting tool capable of securing an associated hose clamp having an associated catch tab and an associated stopper tab, the associated hose clamp includes a pre-clamped state where the associated catch tab is engaged to the associated stopper tab, and a clamped state where the associated catch tab is released from the associated stopper tab, the clamp setting tool comprising:

a first member and a second member, the first member pivotally coupled to the second member forming pliers;

a first head element at a first end of the first member and a second head element at a first end of the second member, each of the first head element and the second head element configured to receive both the associated catch tab and the associated stopper tab of the associated hose clamp;

a first handle at a second end of the first member and a second handle at a second end of the second member; and a stop mechanism positioned between the first and second head elements, the stop mechanism includes a spring-biased sliding pin arrangement secured by one of the first and second head elements, the stop mechanism is configured to prevent movement of the first and second head elements from an open position where the associated hose clamp secured by the clamp setting tool is in the pre-clamped state toward a closed position where the associated hose clamp secured by the clamp setting tool is in the clamped state, wherein the sliding pin arrangement includes a lock pin movable between a locked state and an unlocked state, and the lock pin is biased toward the locked state, wherein the lock pin is movable in hinge parts formed on the first head element, one end of the lock pin includes a cap to limit axial displacement of the lock pin into the first head element, and an opposite end of the lock pin receives a spring and is mounted to a plate.

13. The clamp setting tool of claim 12, wherein each of the first head element includes at least one first notch formed therein and the second head element includes at least one second notch formed therein that positionally corresponds to the at least one first notch, the at least one first and second notches configured to receive both the associated catch tab and the associated stopper tab of the associated hose clamp.

14. The clamp setting tool of claim 13, wherein the at least one first notch includes a first upper notch and a first lower notch, and the at least second notch is a second upper notch aligned with the first upper notch.

15. The clamp setting tool of claim 14, wherein the first and second upper notches are collectively sized for sliding receipt of the associated stopper tab of the associated hose clamp.

16. The clamp setting tool of claim 15, wherein the first lower notch is sized to receive the associated catch tab of the associated hose clamp and allow for a first displacement of the associated catch tab relative to the associated stopper tab along a first direction as the associated hose clamp is moved to the clamped state.

17. The clamp setting tool of claim 16, wherein the first and second head elements define a passageway sized to guide a second displacement of the associated catch tab relative to the associated stopper tab along a second direction as the associated hose clamp is moved to the clamped state.

18. A method of securing a flexible hose onto a hollow shaft via a hose clamp, the hose clamp includes a pre-clamped state where a catch tab is engaged to a stopper tab, and a clamped state where the catch tab is released from the stopper tab, the method comprising:

(a) providing a clamp setting tool including:

(i) a first head element and a second head element, the first head element includes at least one first notch formed therein and the second head element includes at least one second notch formed therein that positionally corresponds to the at least one first notch, and (ii) a stop mechanism connected to one of the first and second head elements, the stop mechanism configured to prevent movement of the first and second head elements from an open position toward a closed position, (b) placing the hose clamp in the pre-clamped state loosely over an end portion of the hose mounted on the hollow shaft;

(c) moving the first and second head elements to the open position and engaging the hose clamp with the clamp setting tool by positioning the catch tab and the stopper tab of the hose clamp within the first and second notches;

(d) with the hose clamp in the pre-clamped state engaged by the clamp setting tool, rotating the clamp setting tool toward an associated component adjacent the hose end portion;

(e) exerting a force on the stop mechanism via contact of the stop mechanism with the associated component to move the stop mechanism from a normally locked state to an unlocked state; and (f) with the stop mechanism in the unlocked state moving the first and second head elements toward the closed position to release the catch tab from the stopper tab, thereby moving the hose clamp to the clamped state.

19. The method of claim 18, wherein the at least one first notch includes a first upper notch and a first lower notch, and the at least second notch is a second upper notch aligned with the first upper notch, and the method includes:

positioning the stopper tab with the first and second upper notches, positioning the catch tab in the first lower notch, and moving the catch tab within the first lower notch to release the catch tab from the stopper tab.

* * * * *